US008353467B2

(12) United States Patent
Hasegawa

(10) Patent No.: US 8,353,467 B2
(45) Date of Patent: Jan. 15, 2013

(54) FLUID SPRAYING GUN

(75) Inventor: Kaga Hasegawa, Tokyo (JP)

(73) Assignee: GA-REW Corporation (JP)

( * ) Notice: Subject to any disclaimer, the term of this patent is extended or adjusted under 35 U.S.C. 154(b) by 367 days.

(21) Appl. No.: 12/667,405

(22) PCT Filed: Dec. 27, 2007

(86) PCT No.: PCT/JP2007/075105

§ 371 (c)(1),
(2), (4) Date: Dec. 31, 2009

(87) PCT Pub. No.: WO2009/004744

PCT Pub. Date: Jan. 8, 2009

(65) Prior Publication Data

US 2010/0176219 A1 Jul. 15, 2010

(30) Foreign Application Priority Data

Jul. 4, 2007 (JP) ..... 2007-176367

(51) Int. Cl.
*B05B 7/26* (2006.01)
*B05B 7/28* (2006.01)

(52) U.S. Cl. ..... 239/317; 239/318; 239/331; 239/227; 239/229; 239/416.5; 239/602

(58) Field of Classification Search ..... 239/310, 239/318, 317, 331, 341, 407, 227, 229, 416.5, 239/602

See application file for complete search history.

(56) References Cited

U.S. PATENT DOCUMENTS 3,109,594 A * 11/1963 Pletcher ..... 239/428

(Continued)

FOREIGN PATENT DOCUMENTS

DE 19838276 A1 2/2000

(Continued)

OTHER PUBLICATIONS

International Search Report for International Application No. PCT/JP2007/075105 mailed Feb. 5, 2008 with English translation.

(Continued)

*Primary Examiner* — Dinh Q Nguyen
*Assistant Examiner* — Jennifer Gordon
(74) *Attorney, Agent, or Firm* — Cantor Colburn LLP

(57) ABSTRACT

A fluid spraying gun of the present invention includes: a tube-shape guide, on which a brush extending forward is implanted; a nozzle, which is formed of a flexible pipe member with a front end thereof as a free end, and sprays one portion of gas, which is supplied from the flow separation portion and passes through the nozzle, toward the brush from the front end thereof, while the nozzle undergoes the gyrating motion guided by the tube-shape guide; an inner nozzle, which sprays gas which has passed through a flow rate adjustment portion from a tip portion thereof; and a liquid distribution pipe, which penetrates the tube-shape guide, links an inside of the tube-shape guide with a liquid supply source, has an intermediate portion into which the inner nozzle is inserted in a state where the inner nozzle is directed toward the tube-shape guide, and draws up liquid from the liquid supply source by a negative pressure arising from spraying of gas by the inner nozzle to cause spraying of liquid on the inside of the tube-shape guide. According to the present invention, it is possible to provide a fluid spraying gun in which a liquid with an adequate flow rate can be mixed with a gas, converted into minute drops and sprayed.

1 Claim, 1 Drawing Sheet

U.S. PATENT DOCUMENTS

| | | | | |
|---|---|---|---|---|
| 5,533,673 | A * | 7/1996 | Wilson et al. | 239/227 |
| 5,620,138 | A * | 4/1997 | Crum | 239/3 |
| 6,003,787 | A * | 12/1999 | Fisher | 239/373 |
| 6,598,803 | B1 | 7/2003 | Haas et al. | |
| 6,883,732 | B2 * | 4/2005 | Hasegawa | 239/416.5 |
| 2003/0029933 | A1 | 2/2003 | Hasegawa | |
| 2005/0145721 | A1 * | 7/2005 | McLaws et al. | 239/317 |

FOREIGN PATENT DOCUMENTS

| | | | |
|---|---|---|---|
| EP | 1104334 | B1 | 11/2003 |
| JP | 12-010311 | Y1 | 7/1937 |
| JP | 8-156751 | A | 6/1996 |
| JP | 2001-286788 | A | 10/2001 |
| JP | 2002-523216 | A | 7/2002 |
| JP | 2003-154294 | A | 5/2003 |
| JP | 2006-334552 | A | 12/2006 |
| WO | 00/10726 | A1 | 3/2000 |

OTHER PUBLICATIONS

Notice of Allowance for Japanese patent application No. 2009-521500 mailing date of May 15, 2012 with English translation.

* cited by examiner

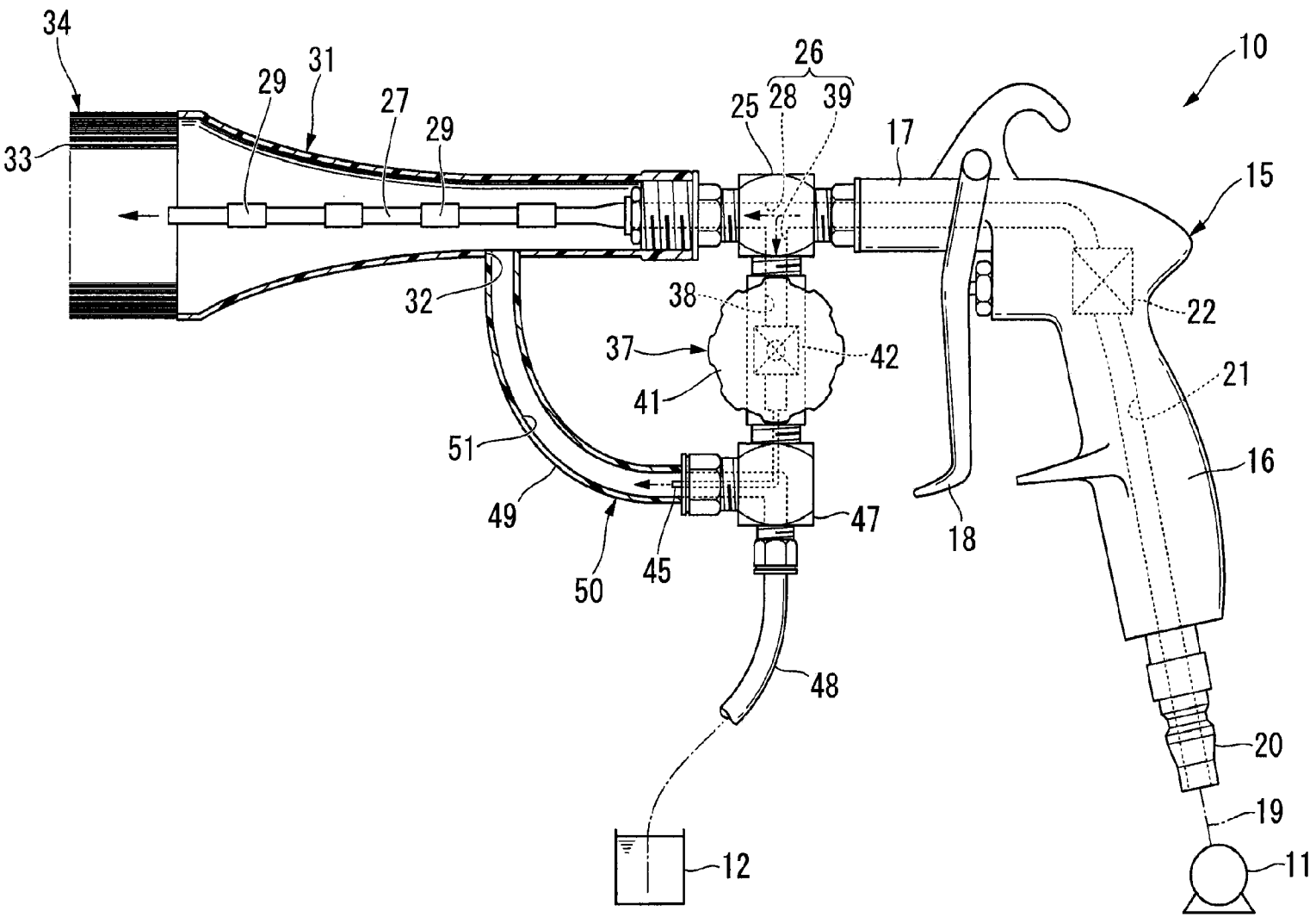
10
15
22
21
16
20
19
11
18
17
42
47
48
26
39
28
25
38
37
41
45
12
50
49
51
32
29
27
31
29
34
33

FLUID SPRAYING GUN

CROSS REFERENCE TO RELATED APPLICATIONS

This is a U.S. national stage of application No. PCT/JP2007/075105, filed on 27 Dec. 2007. Priority under 35 U.S.C. §119(a) and 35 U.S.C. §365(b) is claimed from Japanese Application No. 2007-176367, filed 4 Jul. 2007, the disclosure of which is also incorporated herein by reference.

TECHNICAL FIELD

The present invention relates to a fluid spraying gun which sprays a fluid.

Priority is claimed on Japanese Patent Application No. 2007-176367, filed Jul. 4, 2007, the content of which is incorporated herein by reference.

BACKGROUND ART

Technology relating to a fluid-spraying gun which sprays fluid includes a gun comprising a dual nozzle, having an outer nozzle and an inner nozzle both with flexibility (see for example Patent Reference 1). In this fluid-spraying gun, a gas supplied from a gas supply source passes through the gap between the outer nozzle and the inner nozzle of the dual nozzle and is sprayed. The negative pressure arising from spraying of the gas, while circulating the dual nozzle within a tube-shape guide positioned on the outside of the dual nozzle, causes the liquid in the liquid supply source to be sucked up from the inner nozzle and mixed with the gas, causing the liquid to be converted into minute drops and to be sprayed while circulating the dual nozzle within a tube-shape guide positioned on the outside of the dual nozzle.

Patent Reference 1: Japanese Unexamined Patent Application, First Publication No. 2003-154294

However, in the above fluid spraying gun, a dual nozzle having an outer nozzle and an inner nozzle is used, and gas must be sprayed from the gap between the outer nozzle and the inner nozzle; consequently the inner nozzle is narrow, and liquid cannot be sprayed with an adequate flow rate.

Hence an object of the present invention is to provide a fluid spraying gun which can mix liquid at an adequate flow rate with gas to create and spray minute drops.

DISCLOSURE OF THE INVENTION

A fluid spraying gun of the present invention includes: a gripping portion, on which a rotatable lever is provided; an open/close portion which opens and closes a supply path of gas from a gas supply source, through rotation of the lever; a flow separation portion, which is capable of separating the flow of gas which has passed through the open/close portion in an open state; a tube-shape guide, the diameter of which gradually expands toward a front end thereof, and which has a ring-shape front end portion on which a brush extending forward is implanted; a nozzle, which is formed of a flexible pipe member with a front end thereof as a free end, and sprays one portion of gas, which is supplied from the flow separation portion and passes through the nozzle, toward the brush from the front end thereof, while the nozzle undergoes the gyrating motion guided by the tube-shape guide; a flow rate adjustment portion, which has an operating portion, and adjusts the flow rate of the other portion of gas supplied from the flow separation portion, in accordance with operation input to the operation portion; an inner nozzle, which sprays gas which has passed through the flow rate adjustment portion from a tip portion thereof; and a liquid distribution pipe, which penetrates the tube-shape guide, links an inside of the tube-shape guide with a liquid supply source, has an intermediate portion into which the inner nozzle is inserted in a state where the inner nozzle is directed toward the tube-shape guide, and draws up liquid from the liquid supply source by a negative pressure arising from spraying of gas by the inner nozzle to cause spraying of liquid on the inside of the tube-shape guide.

According to the present invention, when the supply path of gas from the gas supply source is opened by the open/close portion through rotation of the lever provided on the gripping portion, gas supplied from the gas supply source is separated by the flow separation portion, and one portion of gas is sprayed from the tip of the nozzle toward the brush implanted in the ring-shape front end portion of the tube-shape guide, while the nozzle undergoes the gyrating motion under the guidance of the tube-shape guide. At the same time, the other portion of gas separated by the flow separation portion is directed toward the inside of the tube-shape guide and sprayed from the inner nozzle to the inside of the liquid distribution pipe, and liquid is drawn up from the liquid supply source through the liquid distribution pipe due to the negative pressure occurring at this time. This liquid is formed into minute drops by mixing with the gas from the inner nozzle, and is sprayed on the inside of the tube-shape guide. Liquid formed into minute drops in this way and sprayed on the inside of the tube-shape guide is mixed with gas sprayed toward the brush from the tip of the nozzle which undergoes the gyrating motion, further creating minute drops which are sprayed forward from the tube-shape guide. At this time, liquid is drawn up by the liquid distribution pipe, provided separately from the nozzle, so that an adequate amount of liquid can be drawn up. Hence liquid at an adequate flow rate can be mixed with gas to form minute drops and sprayed. Moreover, at this time slight vibrations occur in the brush due to the gas from the gyrating nozzle. For this reason, merely by pressing the brush against an object to be cleaned, cleaning can be performed with the brush, which undergoes slight vibrations while spraying water formed into minute drops. Further, water which has once been absorbed by the brush is further converted into minute drops and sprayed by the high-speed vibrations (5000 to 6000 per minute) of the brush. As a result, cleaning can be performed even of detailed portions of the object to be cleaned, with which the brush does not come into direct contact.

BRIEF DESCRIPTION OF THE DRAWINGS

FIG. 1 is a side view of a fluid spraying gun of one embodiment of the invention, showing a portion in cross-section.

BEST MODE FOR CARRYING OUT THE INVENTION

A fluid spraying gun of one embodiment of the invention is explained below, referring to the drawings.

As shown in FIG. 1, a fluid spraying gun 10 of this embodiment is connected to an air compressor 11 serving as a gas supply source, and receives a supply of compressed air as the gas, and in addition receives a supply of liquid, for example, water or a liquid cleanser, stored in a tank 12 serving as a liquid supply source; the fluid spraying gun 10 mixes the gas and liquid and sprays the mixture to clean an object to be cleaned. Of course, supplies of various other gases and liquids can also be received.

The fluid spraying gun 10 of this embodiment has a gun main unit 15. This gun main unit 15 has a gripping portion 16, which is gripped by the user; a forward-extending portion 17, extending forward from one end of the gripping portion 16; a rotatable lever 18, provided on the gripping portion 16 so as to be positioned along the gripping portion 16; a joint portion 20, which is provided on the other end, which is an end opposite to the end from which the forward-extending portion 17 extends, of the gripping portion 16, and is connected to a pipe 19 leading to the air compressor 11; an internal supply path (supply path) 21, which guides compressed air from the air compressor 11 via the joint portion 20 to the tip end of the forward-extending portion 17 within the gun main unit 15; and an open/close portion 22, which opens and closes the internal supply path 21 through rotation of the lever 18. When the lever 18 is gripped together with the gripping portion 16 and rotated to the side of the gripping portion 16, the open/close portion 22 is in an open state, and when the grip on the lever 18 is released, the open/close portion 22 becomes a closed state by means of the biasing force of a spring, not shown.

A joining flow separation portion (flow separation portion) 25 is mounted on the forward-extending portion 17 of the gun main unit 15. In this joining flow separation portion 25 is formed a flow separation path 26, which is internally connected to the internal supply path 21 of the gun main unit 15, and which can separate compressed air passing through the open/close portion 22 in the open state, forward and downward.

In the center of the forward end portion of the joining flow separation portion 25 is mounted a nozzle 27, so as to extend forward. This nozzle 27 is formed of a cylindrical pipe member having flexibility, with the forward end thereof being a free end, and is joined to the joining flow separation portion 25 at the base end side. The internal path, not shown, of this nozzle 27 is linked to a forward flow separation portion 28 of the flow separation flow path 26 of the joining flow separation portion 25. Here, the entire of the nozzle 27 is made of a flexible material of, for example, nylon, Teflon (a registered trademark), polyurethane, polypropylene, or another synthetic resin; and on the outside thereof, a plurality of weighting portions 29 made of a synthetic resin are fixed.

On the outside of the front end portion of the joining flow separation portion 25 is mounted a tube-shape guide 31 with a ring-shape cross-sectional shape, extending forward, and positioned so as to be on the outside in the radial direction of the nozzle 27. This tube-shape guide 31 is made of a synthetic resin material, and is screwed with the joining flow separation portion 25. This tube-shape guide 31 has a tube shape the diameter of which gradually expands from the joining flow separation portion 25 toward the front end (a so-called horn shape). The tube-shape guide 31 has a hole 32 penetrating within and without at the lower portion of the tube-shape guide 31 in the center portion in the axial-line direction. On the ring-shape front end portion of the tube-shape guide 31 is implanted a brush 34, comprising numerous fibers 33 formed of a flexible synthetic resin material, so as to extend in the forward direction beyond the nozzle 27 along the axial-line direction of the tube-shape guide 31.

When the open/close portion 22 of the gun main unit 15 is in the open state, compressed air is introduced into the nozzle 27 via the internal supply path 21 and the flow separation portion 28 of the joining flow separation portion 25. This compressed air passes through the internal path, not shown, of the nozzle 27, and consequently the nozzle 27 sprays compressed air directed toward the brush 34 from the front end thereof while undergoing a gyrating motion along the inner peripheral wall of the tube-shape guide 31. The weighting portions 29 are provided in order to impart weight, in order that when the nozzle 27 gyrates along the tube-shape guide 31, the gyrations are performed efficiently.

A flow rate adjustment portion 37 is connected to the lower portion of the joining flow separation portion 25. A downward flow separation portion 39 of the flow separation path 26 of the joining flow separation portion 25 is linked to an internal flow path 38 of this flow rate adjustment portion 37. This flow rate adjustment portion 37 has a rotatable knob (operation portion) 41; by adjusting the amount of rotation of this knob 41, a internal valve 42 adjusts the flow rate of compressed air supplied downward via the flow separation portion 39 of the joining flow separation portion 25, between fully-closed and fully-opened. An inner nozzle 45 is mounted on the lower portion of the flow rate adjustment portion 37, and the internal flow path, not shown, of this inner nozzle 45 is linked to a portion of the internal flow path 38 downstream from the valve 42 of the flow rate adjustment portion 37. By this means, the inner nozzle 45 causes compressed air which has passed through the flow rate adjustment portion 37 to be sprayed from the tip.

A joining flow combining portion 47 is mounted on the lower portion of the flow rate adjustment portion 37. A first pipe 48 is mounted on the lower portion of this joining flow combining portion 47, and a second pipe 49, fitted to the hole 32 in the tube-shape guide 31, is mounted in the front portion of the joining flow combining portion 47. The tip portion of the first pipe 48 is inserted into water or liquid cleanser accumulated in the tank 12. By this means, the first pipe 48, the joining flow combining portion 47 and the second pipe 49 constitute a liquid distribution pipe 50 which penetrates the tube-shape guide 31 and links the inside of the tube-shape guide 31 and the tank 12. The inner nozzle 45 is inserted in the intermediate portion of the internal flow path 51 of the liquid distribution pipe 50 so as to be directed toward the tube-shape guide 31.

With the flow rate adjustment portion 37 in the opened state, when the open/close portion 22 of the gun main unit 15 is put into the open state, the flow rate of compressed air supplied via the joining flow separation portion 25 is adjusted by the flow rate adjustment portion 37, and the compressed air is sprayed from the inner nozzle 45 toward the tube-shape guide 31 via the liquid distribution pipe 50. As a result, a negative pressure occurs in the internal flow path 51 of the liquid distribution pipe 50, and the liquid distribution pipe 50 draws up water or liquid cleanser from the tank 12. The water or liquid cleanser, through mixing with compressed air from the inner nozzle 45, becomes minute drops, and in this state is sprayed into the tube-shape guide 31. At this time, by adjusting the rotation angle of the knob 41, the flow rate of the water or liquid cleanser sprayed into the tube-shape guide 31 can be adjusted.

When using the above-described fluid spraying gun 10 of this embodiment to spray water, with the first pipe 48 inserted into the tank 12 in which water is accumulated, the user grips the gripping portion 16 and pulls and rotates the lever 18 provided on the gripping portion 16 to the side of the gripping portion 16. The rotation of this lever 18 causes the open/close portion 22 to open the internal supply path 21 for compressed air from the air compressor 11. Then, compressed air supplied from the air compressor 11 flows and is separated by the flow separation path 26 such that one portion of compressed air is sprayed toward the brush 34 of the tube-shape guide 31 from the tip of the nozzle 27, while the nozzle 27 is caused to undergo gyrating motion guided by the tube-shape guide 31. At the same time, the other portion of compressed air separated in the direction of the flow separation portion 39 is sprayed from the inner nozzle 45 to the inside of the liquid distribution pipe 50 in a state of being directed toward the inside of the tube-shape guide 31. Furthermore, a negative pressure occurring at this time causes the liquid distribution pipe 50 to draw up water from the tank 12, which is mixed with compressed air from the inner nozzle 45 to become minute drops, and in this state the water is sprayed into the inside of the tube-shape guide 31. Water in the state of minute drops, sprayed into the inside of the tube-shape guide 31 in this manner, is mixed with compressed air sprayed from the tip of the nozzle 27 undergoing gyrating motion toward the brush 34 to further form minute drops (mist) and is sprayed forward from the tube-shape guide 31. At this time, slight vibrations occur in the brush 34 due to the compressed air from the gyrating nozzle 27. Water which is once absorbed by the brush 34 is further converted into minute drops by the high-speed vibrations (5000 to 6000 per minute) of the brush 34 and is sprayed. The user can perform cleaning merely by holding the brush 34 against the object to be cleaned since the object to be cleaned is rubbed with the brush 34 which vibrates minutely and sprays water in the form of minute drops.

As described above, the fluid spraying gun 10 of this embodiment draws up liquid using the liquid distribution pipe 50 provided separately from the nozzle 27, so that an adequate amount of water can be drawn up. Hence water can be mixed with air at an adequate flow rate to generate and spray minute drops, so that cleaning can be performed satisfactorily.

Moreover, an adequate quantity of water converted into minute drops can be passed over the inner face of the tube-shape guide 31, so that water serves as a lubricant to prevent scratching of the inner face of the tube-shape guide 31 due to high-speed gyration of the nozzle 27. In particular, when cleaning is performed while the brush 34 is rubbed against the surface of the object to be cleaned, even though dust components removed from the object to be cleaned rebound and attempt to enter the interior of the tube-shape guide 31, this entry of dust components can be suppressed. Therefore, it is possible to prevent action of dust components as an abrasive to cause scratching of the inner face of the tube-shape guide 31 during gyration of the nozzle 27. Further, the brush 34 itself is constantly cleaned by water in the form of minute drops, so that separate cleaning of the brush 34 is unnecessary.

Further, by adjusting the separate flow rates of compressed air using the flow rate adjustment portion 37, the amount of water supplied can be adjusted, so that the amount of water supplied can be adjusted by means of a simple construction.

In addition, by bringing the brush 34 into contact with the object to be cleaned, contact of the gyrating nozzle 27 with the object to be cleaned can be prevented, and the distance between the nozzle 27 and the object to be cleaned can be determined as a position at which cleaning by the nozzle 27 is effectively performed.

On the other hand, when using the fluid spraying gun 10 of this embodiment to spray liquid cleanser, by inserting the first pipe 48 into the tank 12 in which liquid cleanser is accumulated, the liquid distribution pipe 50 can draw up liquid cleanser by means of a negative pressure resulting from spraying of compressed air from the inner nozzle 45 to the inside of the liquid distribution pipe 50. The liquid cleanser is mixed with compressed air and becomes in a foamy state, and is sprayed to the inside of the tube-shape guide 31. The foamy liquid cleanser is mixed with compressed air sprayed from the tip of the nozzle 27 undergoing gyrating motion toward the brush 34 to further convert into minute foam, and is sprayed to the front of the tube-shape guide 31. At this time also, slight vibrations occur in the brush 34 due to compressed air from the gyrating nozzle 27. The user performs cleaning by rubbing the brush 34, which vibrates minutely and sprays cleanser in the foamy state, against the object.

Water which has once been absorbed by the brush 34 is further converted into minute drops by high-speed vibrations of the brush 34 and is sprayed, so that even detailed portions of the object which are not directly in contact with the brush 34 can be cleaned.

INDUSTRIAL APPLICABILITY

According to a fluid spraying gun of the present invention, a liquid with an adequate flow rate can be mixed with a gas, converted into minute drops and sprayed. Further, merely by bringing the brush into contact with the object to be cleaned, cleaning can be performed with the brush which vibrates minutely and sprays water in the form of minute drops. Moreover, even detailed portions of the object to be cleaned, with which the brush does not come into direct contact, can be cleaned.

The invention claimed is:

1. A fluid spraying gun, comprising:

a gripping portion, on which a rotatable lever is provided; an open/close portion which opens and closes a supply path of gas from a gas supply source, through rotation of the lever; a flow separation portion, which separates the flow of gas which has passed through the open/close portion in an open state into a forward flow portion and a downward flow portion; a tube-shape guide, the diameter of which gradually expands toward a front end thereof, and which has a ring-shape front end portion on which a brush extending forward is implanted; a nozzle, which is formed of a flexible pipe member with a front end thereof as a free end, and sprays one portion of gas, which is supplied from the forward flow portion and passes through the nozzle, toward the brush from the front end thereof, while the nozzle undergoes the gyrating motion guided by the tube-shape guide; a flow rate adjustment portion, which has an operating portion, and adjusts the flow rate of another portion of gas supplied from the downward flow portion, in accordance with operation input to the operation portion; an inner nozzle, which sprays gas from a tip thereof, the gas having passed through the downward flow portion; and a liquid distribution pipe, which penetrates the tube-shape guide, links an inside of the tube-shape guide with a liquid supply source, has an intermediate portion into which the inner nozzle is inserted in a state where the inner nozzle is directed toward the tube-shape guide, and draws up liquid from the liquid supply source by a negative pressure arising from spraying of gas by the inner nozzle to cause spraying of liquid on the inside of the tube-shape guide.

* * * * *